United States Patent [19]

Sugitani et al.

[11] 4,444,589

[45] Apr. 24, 1984

[54] HEAT RESISTANT ALLOY EXCELLENT IN BENDING PROPERTY AND DUCTILITY AFTER AGING AND ITS PRODUCTS

[75] Inventors: Junichi Sugitani; Makoto Takahashi, both of Hirakata, Japan

[73] Assignee: Kubota, Ltd., Osaka, Japan

[21] Appl. No.: 370,197

[22] Filed: Apr. 21, 1982

[30] Foreign Application Priority Data

Apr. 27, 1981 [JP] Japan ..... 56-64550
Apr. 27, 1981 [JP] Japan ..... 56-64551

[51] Int. Cl.[3] ..... C22C 39/22; C22C 39/26

[52] U.S. Cl. ..... 75/128 G; 75/128 R; 420/584

[58] Field of Search ..... 75/122, 128 R, 134 F, 75/128 G

[56] References Cited

U.S. PATENT DOCUMENTS 3,627,516 12/1971 Bellot et al. ..... 75/128 G
3,833,358 1/1972 Bellot et al. ..... 75/122

*Primary Examiner*—Veronica O'Keefe
*Attorney, Agent, or Firm*—Armstrong, Nikaido, Marmelstein & Kubovcik

[57] ABSTRACT

A heat resistant alloy excellent in bending property and ductility after aging, comprising 0.12 to 0.33% (by weight, the same as hereinafter) of C, less than 1.2% of Si, less than 1.5% of Mn, 23 to 25% of Cr, 37 to 40% of Ni, 0.5 to 1.8% of Nb and 0.04 to 0.15% of N, the balance being substantially Fe and unavoidable impurities, with the mutual relationship of C and Si contents represented by the range indicated by hatching in FIG. 1, which may be manufactured into tubes by centrifugal casting, to be used as deformed tubes after bending.

4 Claims, 1 Drawing Figure

HEAT RESISTANT ALLOY EXCELLENT IN BENDING PROPERTY AND DUCTILITY AFTER AGING AND ITS PRODUCTS

BACKGROUND OF THE INVENTION

The present invention relates to a Nb containing high Ni-high Cr heat resistant alloy excellent in bending property and in ductility at ambient temperature after aging, and its products.

Since reformer tubes and cracking tubes used in the petroleum industries are normally exposed to a wide range of high temperature from about 500° to 1,100° C. in the heating furnace, high creep rupture strength must be ensured even in such a high temperature range. To meet this requirement, high Ni-high Cr heat resistant alloys like HK 40 (0.4%C, 25%Cr-20%Ni), HP 50 (0.5%C, 25%Cr-35%Ni) or such alloys in which Nb is further contained are in use.

However, the above-mentioned heat resistant alloy materials such as HK 40 or HP 50 having high C contents precipitate large amount of secondary carbides, when heated to high temperature in the heating furnace after casting. Especially at a heating temperature range of from 800° to 900° C., the precipitation takes place in the shortest period of time and most prominently. As a result, the material is embrittled, with notable degradation in the ductility in the temperature range from room temperature to about 650° C.

Because of such notable degradation in the ductility after aging, conventional cracking tubes (straight formed tubes) have such drawback that they are liable to fracture by slight bending, tensile deformation or thermal shock, when they are repaired after use.

The cracking tubes are connected with deformed cast tubes such as return bends or 90° elbows by welding, and are formed to cracking coil. However, the conventional deformed cast tubes mentioned above are made by static casting method, therefore tube wall must be made thick in order to have a cast tube free from shrinkage cavity; as a consequence, the grains grow coarser, and the ductility after aging or after casting degrades with the result that the aforementioned drawbacks are magnified. In addition, when starting the operation of a newly built heating furnace, or when replacing the tubes with new ones in an already installed heating furnace, release of various residual stress of the said tubes (for example, residual stress resulting from welding or casting in the tube manufacturing process) and their accustoming to the piping system (dimensional stabilization from their thermal expansion) occur during the period of several hundred hours after the start-up. For this reason, a great care should be taken not to impose excessive force on tubes, return bends and so on when operating the furnace. However, should emergency stop of operation be made resulting whatever trouble during the leading period of the operation, there is a strong likelihood that such tubes or the like are susceptible to fracture due to abrupt coolings.

On the other hand, the aforementioned cracking tubes are preferably to be used as deformed tubes. When applying the cracking tube to the return bend (180° bent tube) or the 90° elbow (90° bent tube) for ethylene cracking coils, but tubes made by conventional materials are inferior in the bending property, and thus involve problem that minute cracks develop on the inside and outside surfaces of the bent tube at the hot bending process like an induction-heat bending, therefore such tubes are not in use. In the case deformed tubes such as return bends or the like can be made by bending straight tubes in place of the conventional static casting method, a great advantage will be obtained in respect of reducing the wall thickness of the tubes, with the result that deterioration of ductility accompanied by aforementioned grain coarsening shall be avoided, and moreover, thermal stress occurred by temperature difference between the inside and outside surface of the tube wall can be inhibited smaller in comparison with deformed tubes made by the conventional static casting.

In view of the above problem, inventors have conducted intensive research on the compositions of high Ni-high Cr heat resistant alloys containing Nb, and found that imbalance of the C, Si and Nb contents precipitates segregated bands around grain boundaries, the bands have small deformabilities, therefore the segregated bands result in the degradation in the bending property, and that since the said segregated bands accelerate precipitation of the secondary carbides in the high temperature range, notable deterioration in ductility at ambient temperature after aging is caused.

SUMMARY OF THE INVENTION

An object of this invention is to provide a heat resistant cast alloy comprising about 0.12 to 0.33% (by weight, the same as hereinafter) of C, less than about 1.2% of Si, less than about 1.5% of Mn, about 23 to 25% of Cr, about 37 to 40% of Ni, about 0.5 to 1.8% of Nb and about 0.04 to 0.15% of N, balance being substantially iron and unavoidable impurities, with C and Si having relative contents falling within the range in FIG. 1 surrounded by the point A, B, E and D, and indicated by hatching.

A further object of this invention is to provide a deformed tube in arbitrary shapes in which properly balanced contents of C, Si and Nb inhibit the formation of segregated bands of Nb and Si in the neighborhood of the grain boundaries, with resultant improvement in the bending property and the ductility at ambient temperature after aging, and centrifugal casting adopted in place of the conventional static pouring makes it possible to avoid the generation of cracks even in hard bending.

DETAILED DESCRIPTION OF THE INVENTION

Figure 1:
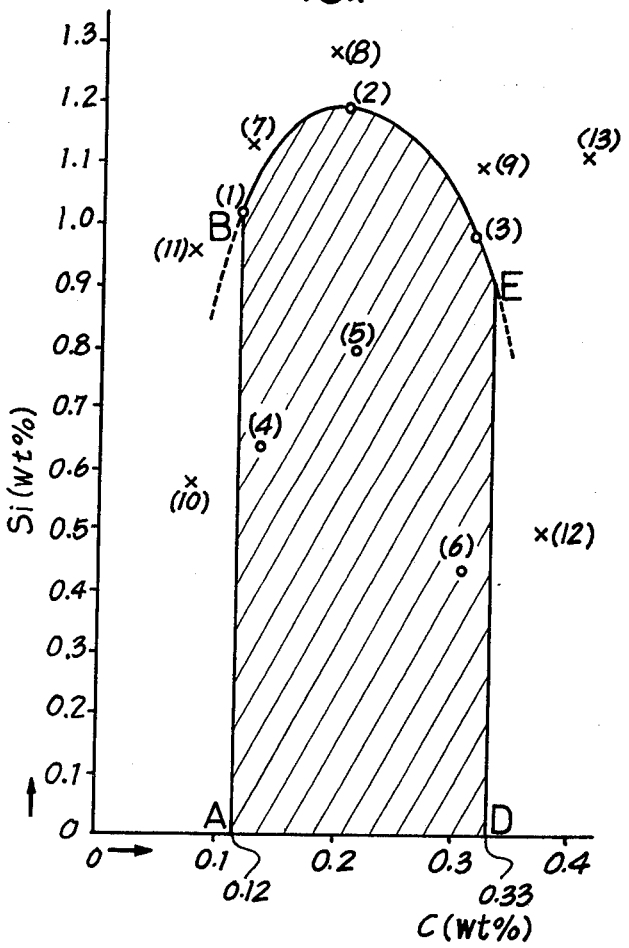
FIG. 1 is a graph showing the relationship between the values of cold tensile elongation after aging and the C-Si contents of high Ni-high Cr heat resistant alloys containing Nb.

In the following, the reason for limiting the compositions of a heat resistant casting alloy of this invention is described.

C is required for ensuring the creep rupture stength at high temperatures which call for the use of such heat resistant alloys. If this amount is less than 0.12%, the creep rupture strength at above 1,000° C. is insufficient. However, if it exceeds about 0.33%, the precipitation of the secondary carbides in the aging process becomes excessive, causing deterioration in ductility after aging. Accordingly, the lower limit should be set at about 0.12%, and the upper limit at about 0.33%.

Si is effective for improving the resistance to carburizing of tubes in carburizing atmosphere inside the heating furnace, but if its amount is in excess of about 1.2%, the ductility after aging declines. Accordingly, about 1.2% shall be set as the upper limit.

The contents of C and Si must be limited by their mutual relationship in addition to the aforementioned requirements. FIG. 1 is a graph showing the relationship between the values (%) of the tensile elongation (reupture elongation) at ambient temperature and the corelated contents of C and Si, when high Ni-high Cr heat resistant alloys containing Nb are held for 100 hours at temperatures at which the most notable degradation in the ductility at ambient temperature occurs, from 800° C. to 900° C. In the graph, "o" designates an elongation value higher than 10%, while "x" represents a value lower than 10%. Although it is generally considered that the cold ductility after aging becomes higher when the C content is smaller, the high Ni-high Cr alloys containing Nb of this invention show a singular tendency depending on the mutual relationship between C and Si, and thus the ductility at ambient temperature declines as their contents are outside the hatched region defined by the point A, B, E and D. The singular tendency is attributed to the fact that the contents of C, Si and Nb in the neighborhood of grain boundaries get imbalanced in the heating process, producing segregated bands of Si and Nb, which notably accelerate the precipitation of secondary carbides at 800° C. to 900° C. Thus, this invention sets the limitations on the contents of C and Si within the range surrounded by the point A, B, E and D, and indicated by hatching in FIG. 1. In that way, the formation of segregated bands of Nb and Si in the neighborhood of grain bondaries and the precipitation of secondary carbides are inhibited, thereby ensuring high ductility at ambient temperature.

Since the aforementioned segregated bands of Nb and Si diminish deformabilities, conventional materials have low workability. Cracking tends to occur on the tube surface, when a tube of such a material is subjected to induction heat treatment for forming a return bend (180° bent tube) or a 90° elbow (90° bent tube). Accordingly, it was difficult to manufacture return bends especially with a radius of curvature smaller than 5 times the tube diameter. In the alloys of this invention, the formation of the aforementioned segregated bands which are inimical to the workability is suppressed, therefore high workability can be achieved to overcome difficulties mentioned in the above.

Mn is effective as a deoxidant in the refining process of molten metal. However, its large amount of use will reduce the resistance to oxidation. For this reason, its content should be set below about 1.5%.

Cr is used for improving the resistance to oxidation. Its contents less than about 23% show insufficient resistance to oxidation above 1,000° C.; on the other hand, its content in excess of about 25% will reduce the ductility at ambient temperature after aging and so the weldability. Appropriate contents should be 23 to 25%.

Ni has the effects of improving the resistance to carburization and to oxidation and also enhancing creep rupture strength and mechanical properties. However, its content is less than about 37%, the resistance to carburization is insufficient. With increasing contents of Ni, the aforementioned properties are improved, but a use of more than about 40% is not economical because its effects of improving the mechanical properties and the resistance to oxidation reach nearly saturation at such high contents. Thus, the favorable values should be about 37 to 40%.

Nb contributes to improvement of the creep rupture strength by forming its carbide and carbo-nitride. With less than about 0.5% of this element, its effect is insufficient, and when the C content is in the range above-mentioned, the ductility after aging can not be ensured. However, with its content in excess of about 1.8%, the precipitation of the aforementioned compounds becomes excessive, inviting reduction in the creep rupture strength and degradation of the resistance to oxidation. Accordingly, contents of about 0.5 to 1.8% are preferable.

N enhances the creep rupture strength by forming, in joint use with C, carbo-nitrides of Cr, Nb, etc., as described above. For this reason, its content of at least about 0.04% is required. However, its content in excess of about 0.15% will cause degradation of the weldability. Its content should preferably be about 0.04 to 0.15%.

P, S and other impurities may be allowed to exist in the ranges normally permitted for the alloys of this type.

In manufacturing a deformed tube, for example, by utilizing the heat resistant alloy of this invention, a tube having the aforementioned composition is cast by the centrifugal casting method, and then, this tube is bent.

While in cast tubes formed by static pouring method, the design thickness of wall must be set large for prevention of casting flaws such as shrinkage cavities, and as a consequence, degradation in ductility due to the coarser structure is unavoidable. The above-mentioned disadvantage can be overcome by reducing the thickness of the cast tube by adopting the centrifugal casting method, and this, in concert with the effect of improving the ductility and workability based on the aforementioned chemical compositions, enables production of cast tubes which withstand rigorous bending as demonstrated in the embodiment later. Deformed tubes obtained in this way get no cracking when bent, and show excellent ductility after aging.

In the following, an embodiment of the heat resistant alloy of this invention is described.

EXAMPLE

High Ni-high Cr alloys containing Nb of the various compositions listed in Table 1 were prepared in a basic induction furnace and were made by centrifugal casting into tubes having 130 mm outside diameter, 2,550 mm length and 21 mm thickness. In Table 1, the test materials Nos. 1 to 6 represent the heat resistant alloys of this invention, while Nos. 7 to 13 give comparison materials having compositions deviating from the range specified by this invention for C and/or Si content(s).

Test pieces to investigate the mechanical properties were cut out from respective centrifugally cast tubes and were made into a dimension of 12.7 mm in outside diameter and 50.8 mm in gauge length. Each cast tube was subjected to bending after induction-heated, and compared in respect to the condition of the development of minute cracks on the inside and outside surfaces of bent portions of the tube while being subjected to the said process.

Table 2 gives the results of the tensile test at room temperature on as-cast materials; Table 3 tabulates the values of rupture elongation in the tensile test at room temperature after aging at 700° C. to 1,000° C. (the treating time period is 100 hours for all of them), and Table 4 shows the results of bending test to a bending radius of 4D (D denotes the outside diameter of the tube). The dimensions of tubes when subjected to the bending are 125 mm outside diameter, 12.5 mm thickness and 2,400 mm length.

TABLE 1

| No. | Chemical compositions of test materials (wt %) C | Si | Mn | Cr | Ni | Nb | N | |
|---|---|---|---|---|---|---|---|---|
| 1 | 0.12 | 1.01 | 1.06 | 24.6 | 38.1 | 1.25 | 0.06 | Materials of this invention |
| 2 | 0.21 | 1.18 | 1.06 | 23.9 | 38.3 | 1.28 | 0.04 | |
| 3 | 0.31 | 0.96 | 1.03 | 24.5 | 37.7 | 1.31 | 0.08 | |
| 4 | 0.14 | 0.63 | 0.98 | 24.7 | 37.2 | 1.26 | 0.07 | |
| 5 | 0.22 | 0.79 | 1.10 | 23.9 | 37.6 | 1.30 | 0.06 | |
| 6 | 0.30 | 0.42 | 1.05 | 24.0 | 37.5 | 1.32 | 0.06 | |
| 7 | 0.13 | 1.12 | 1.05 | 24.1 | 37.8 | 1.22 | 0.07 | Materials for comparison |
| 8 | 0.20 | 1.27 | 1.04 | 24.2 | 38.1 | 1.20 | 0.06 | |
| 9 | 0.32 | 1.08 | 1.05 | 24.3 | 37.9 | 1.30 | 0.07 | |
| 10 | 0.08 | 0.57 | 1.04 | 24.2 | 38.0 | 1.26 | 0.13 | |
| 11 | 0.08 | 0.95 | 1.01 | 24.2 | 38.1 | 1.19 | 0.13 | |
| 12 | 0.37 | 0.48 | 1.07 | 24.0 | 38.5 | 1.20 | 0.09 | |
| 13 | 0.41 | 1.10 | 1.04 | 24.3 | 38.2 | 1.27 | 0.08 | |

Balance being substantially Fe and unavoidable impurities.

TABLE 2

| No. | Results of tensile test at room temperature of as-cast materials: Tensile strength (kg/mm²) | Rupture elongation (%) | |
|---|---|---|---|
| 1 | 58.9 | 37.7 | Materials of this invention |
| 2 | 60.3 | 28.9 | |
| 3 | 61.5 | 26.8 | |
| 4 | 59.5 | 35.5 | |
| 5 | 62.0 | 31.0 | |
| 6 | 62.7 | 28.4 | |
| 7 | 58.6 | 37.0 | Materials for comparison |
| 8 | 61.1 | 26.6 | |
| 9 | 62.0 | 27.0 | |
| 10 | 60.0 | 44.7 | |
| 11 | 59.6 | 45.6 | |
| 12 | 63.1 | 24.8 | |
| 13 | 62.8 | 22.7 | |

TABLE 3

| No. | Values of rupture elongation in tensile test at room temperature after aging (%) — Aging temperature: 700° C. | 800° C. | 900° C. | 1000° C. | |
|---|---|---|---|---|---|
| 1 | 23.7 | 23.7 | 20.7 | 21.9 | Materials of this invention |
| 2 | 17.6 | 16.5 | 15.9 | 18.5 | |
| 3 | 15.8 | 13.9 | 14.7 | 16.6 | |
| 4 | 27.5 | 26.4 | 24.8 | 28.8 | |
| 5 | 19.2 | 17.7 | 18.1 | 23.3 | |
| 6 | 16.0 | 14.6 | 14.9 | 18.3 | |
| 7 | 22.6 | 9.4 | 8.9 | 20.7 | Materials for comparison |
| 8 | 15.7 | 9.6 | 7.4 | 16.5 | |
| 9 | 15.4 | 9.4 | 7.3 | 16.2 | |
| 10 | 29.1 | 8.0 | 8.9 | 25.9 | |
| 11 | 29.6 | 7.8 | 9.6 | 25.5 | |
| 12 | 12.2 | 8.9 | 6.6 | 12.9 | |
| 13 | 10.7 | 8.2 | 6.9 | 12.3 | |

TABLE 4

| No. | Bending test results: Condition of the development of defects on the in and outside surfaces of tube | |
|---|---|---|
| 1 | No cracking | Materials of this invention |
| 2 | No cracking | |
| 3 | No cracking | |
| 4 | No cracking | |
| 5 | No cracking | |
| 6 | No cracking | |
| 7 | Numerous minute cracks (craking lengths less than 0.8 mm) developed on the tensile side | Materials for comparison |
| 8 | Numerous minute cracks (craking lengths less than 0.8 mm) developed on the tensile side | |
| 9 | Numerous minute cracks (craking lengths less than 0.8 mm) developed on the tensile side | |
| 10 | Numerous minute cracks (craking lengths less than 0.8 mm) developed on the tensile side | |
| 11 | Numerous minute cracks (craking lengths less than 0.8 mm) developed on the tensile side | |
| 12 | Large cracks (craking lengths 1~3 mm) developed on the tensile side | |
| 13 | Large cracks (craking lengths 1~3 mm) developed on the tensile side | |

It should be noted that the spots plotted on the aforementioned FIG. 1 are for the test results divided into 2 ranges by the 10% border in the rupture elongation at temperatures from 800° C. to 900° C. ("o" represents materials which gave rupture elongation higher than 10%, while "x" stands for those less than 10%). Numerals in the graph refer to the test material Nos.

The aforementioned test results indicate that the alloys of this invention give high ductilities in cold conditions, even after undergoing the aging treatment, and provide stable high ductilities in disregard of the aging temperature. Particularly, their ductilities at ambient temperature after aging from 800° C. to 900° C. where their embritting trend is maximum are very high, as compared with the materials for comparison.

Table 4 clearly reveals that in all materials for comparison Nos. 7 to 13, cracks occurred under only slight tensile deformations at high temperatures. This is due to that the formation of segregated bands of Nb and Si resulted from imbalanced contents of C, Si and Nb, and the said bands have low deformabilities. Large cracks prticularly occurred on Nos. 12 and 13, because they are high carbon materials despite small Si content. In contrast, no cracks were recognized on the tubes of this invention.

As described in the foregoing, because of the excellent ductilities after aging of the heat resistant alloys of this invention, if they are formed into tubes by the centrifugal casting method, for example, to be used as reformer tubes or cracking tubes, these tubes will exhibit stable durability without easily sustaining damages like conventional materials, even when they have received various stress and strain from welding, cutting, machining, etc., in their recovery work, or when they come across unexpected events such as emergency stop of operation.

Furthermore, because the alloy of this invention excels in the bending property, it is feasible with the alloy to form such tubes as S bent tubes or three dimensionally bent tubes, etc., in addition of 90° elbows and return bends. It should be also noted that the bending work is normally performed by hot bending as by induction-heat bending, but cold bending work may be applicable, and various deformed tubes having arbitary configurations can be manufactured.

It is obvious that the alloy of this invention will achieve the similar effects as above-described, when used as tube materials for various heat exchangers including radiant tubes or the like.

The scope of the invention is not limited to the foregoing description, but various modifications can be made with ease by one skilled in the art without departing from the spirit of the invention. Such modifications are therefore included within the scope of the invention.

What is claimed is:

1. A heat resistant alloy having excellent property of bending and high ductility after aging, consisting essentially of the following components in the following proportions in terms of % by weight:

| | |
|---|---|
| C | 0.12–0.33 |
| O < Si ≦ 1.2 | |
| O < Mn ≦ 1.5 | |
| Cr | 23–25 |
| Ni | 37–40 |
| Nb | 0.5–1.8 |
| N | 0.04–0.15 |

the balance being substantially Fe and unavoidable impurities, with the mutual relationship of C and Si contents being represented by the region surrounded by the points A, B, E and D, and indicated by hatching in FIG. 1.

2. A deformed tube formed by bending a centrifugally cast tube of heat resistant alloy, consisting essentially of the following components in the following proportions in terms of % by weight:

| | |
|---|---|
| C | 0.12–0.33 |
| O < Si ≦ 1.2 | |
| O < Mn ≦ 1.5 | |
| Cr | 23–25 |
| Ni | 37–40 |
| Nb | 0.5–1.8 |
| N | 0.04–0.15 |

the balance being substantially Fe and unavoidable impurities, with the mutual relationship of C and Si contents being represented by the region surrounded by the points A, B, E and D, and indicated by hatching in FIG. 1.

3. The deformed tube as defined in claim 2, wherein the said tube is a 180° bent tube.

4. The deformed tube as defined in claim 2, wherein the said tube is a 90° bent tube.

* * * * *